US010890150B2

(12) United States Patent
Reeve

(10) Patent No.: US 10,890,150 B2
(45) Date of Patent: Jan. 12, 2021

(54) FUEL INJECTION VALVE

(71) Applicant: A.P. Møller—Mærsk A/S, Copenhagen K (DK)

(72) Inventor: Tim Reeve, Copenhagen (DK)

(73) Assignee: A.P. Møller—Mærsk A/S, Copenhagen K (DK)

( * ) Notice: Subject to any disclaimer, the term of this patent is extended or adjusted under 35 U.S.C. 154(b) by 0 days.

(21) Appl. No.: 16/569,511

(22) Filed: Sep. 12, 2019

(65) Prior Publication Data

US 2020/0003133 A1 Jan. 2, 2020

Related U.S. Application Data

(63) Continuation of application No. PCT/EP2018/056281, filed on Mar. 13, 2018.

(30) Foreign Application Priority Data

Mar. 13, 2017 (GB) ..... 1703938.9
Nov. 28, 2017 (GB) ..... 1719717.9

(51) Int. Cl.
*F02M 57/02* (2006.01)
*F02D 19/04* (2006.01)
(Continued)

(52) U.S. Cl.
CPC ..... *F02M 57/02* (2013.01); *F02D 19/04* (2013.01); *F02D 19/0602* (2013.01);
(Continued)

(58) Field of Classification Search
CPC .... F02M 57/02; F02M 51/0671; F02M 61/10; F02D 19/04; F02D 19/0602; F02D 19/0668; F02D 19/0684; F02D 41/0025
(Continued)

(56) References Cited

U.S. PATENT DOCUMENTS 3,398,936 A 8/1968 Delano
3,591,086 A 7/1971 Levin
(Continued)

FOREIGN PATENT DOCUMENTS

CA 1308976 C 10/1992
CN 2173311 Y 8/1994
(Continued)

OTHER PUBLICATIONS

United Kingdom Search and Examination report dated May 18, 2018 for UK Application No. 1719716.1.
(Continued)

*Primary Examiner* — Mahmoud Gimie
(74) *Attorney, Agent, or Firm* — EIP US LLP

(57) ABSTRACT

Disclosed is a slurry fuel injector valve, comprising: a fuel outlet valve through which slurry fuel is able to exit the slurry fuel injector valve towards a combustion chamber of an engine; a pump cavity; a pump element that divides the pump cavity into a pump chamber and an actuation chamber; a fuel conduit through which slurry fuel is flowable from the pump chamber to the fuel outlet valve; and an actuation fluid conduit through which actuation fluid is flowable from the actuation chamber to the fuel outlet valve.

13 Claims, 5 Drawing Sheets

(51) Int. Cl.

| | |
|---|---|
| ***F02M 61/10*** | (2006.01) |
| ***F02M 51/06*** | (2006.01) |
| ***F02D 19/06*** | (2006.01) |
| *F02D 41/00* | (2006.01) |

(52) U.S. Cl.
CPC ..... *F02D 19/0657* (2013.01); *F02D 19/0668* (2013.01); *F02D 19/0684* (2013.01); *F02M 51/0671* (2013.01); *F02M 61/10* (2013.01); *F02D 41/0025* (2013.01)

(58) Field of Classification Search
USPC ..... 123/304
See application file for complete search history.

(56) References Cited

U.S. PATENT DOCUMENTS

| | | | | |
|---|---|---|---|---|
| 3,950,147 | A | 4/1976 | Funk et al. | |
| 4,408,718 | A | 10/1983 | Wich | |
| 4,412,657 | A | 11/1983 | Mowbray | |
| 4,633,830 | A * | 1/1987 | Oshima | F02B 23/0624 123/261 |
| 4,662,315 | A | 5/1987 | Sommer | |
| 4,782,794 | A | 11/1988 | Hsu et al. | |
| 4,862,837 | A | 9/1989 | Holmes | |
| 4,991,771 | A | 2/1991 | Porchet et al. | |
| 5,056,469 | A | 10/1991 | Kimberley | |
| 5,193,575 | A | 3/1993 | Do | |
| 5,282,570 | A * | 2/1994 | Johnson | F02M 65/005 239/5 |
| 6,213,093 | B1 | 4/2001 | Yudanov et al. | |
| 6,237,857 | B1 | 5/2001 | Ausman et al. | |
| 2003/0075153 | A1 | 4/2003 | Augustin et al. | |
| 2004/0025843 | A1* | 2/2004 | Magel | F02M 63/0026 123/446 |
| 2008/0047527 | A1* | 2/2008 | Sun | F02M 57/025 123/446 |
| 2012/0056018 | A1 | 3/2012 | Kobayashi | |
| 2013/0233946 | A1* | 9/2013 | Kobayashi | F02M 61/162 239/403 |
| 2014/0314603 | A1 | 10/2014 | Inoue et al. | |
| 2017/0051712 | A1* | 2/2017 | Sauvetre | F02M 61/10 |

FOREIGN PATENT DOCUMENTS

| | | | | |
|---|---|---|---|---|
| CN | 104791786 | A | 7/2015 | |
| CN | 207761863 | U * | 8/2018 | F02M 61/18 |
| DE | 102007000159 | A1 | 9/2007 | |
| EP | 0957262 | A2 | 11/1999 | |
| EP | 1780401 | A1 | 5/2007 | |
| EP | 1837515 | A1 | 9/2007 | |
| EP | 1965070 | A1 | 9/2008 | |
| EP | 2940287 | A | 11/2015 | |
| EP | 3070321 | A1 | 9/2016 | |
| EP | 3070322 | A1 | 9/2016 | |
| GB | 473174 | A | 10/1937 | |
| GB | 868093 | A * | 5/1961 | F02M 61/163 |
| JP | H06147057 | A | 5/1994 | |
| JP | H07103106 | A | 4/1995 | |
| JP | H0311264 | A | 11/1998 | |
| JP | 2014227913 | A | 12/2014 | |
| WO | 2004088122 | A1 | 10/2004 | |
| WO | 2011162681 | A1 | 12/2011 | |

OTHER PUBLICATIONS

United Kingdom Search and Examination report dated May 23, 2018 for UK Application No. 1719717.9.
United Kingdom Search and Examination report dated May 24, 2018 for UK Application No. 1719718.7.
International Search Report dated May 22, 2018 for PCT Application No. PCT/EP2018/056276.
International Search Report dated May 25, 2018 for PCT Application No. PCT/EP2018/056278.
International Search Report dated May 24, 2018 for PCT Application No. PCT/EP2018/056281.
International Search Report dated Jun. 5, 2018 for PCT Application No. PCT/EP2018/056283.
United States Office Action dated May 28, 2020 for U.S. Appl. No. 16/569,464.
European Article 94(3) Examination report dated Oct. 2, 2020 for EP Application No. 18714981.0.
European Article 94(3) Examination report dated Oct. 6, 2020 for EP Application No. 18714978.6.

* cited by examiner

FUEL INJECTION VALVE

CROSS-REFERENCE TO RELATED APPLICATIONS

This application is a continuation of International Application No. PCT/EP2018/056281, filed Mar. 13, 2018, which claims priority to UK Application No. GB 1703938.9, filed Mar. 13, 2017, and UK Application No. GB 1719717.9, filed Nov. 28, 2017, under 35 U.S.C. § 119(a). Each of the above-referenced patent applications is incorporated by reference in its entirety.

BACKGROUND OF THE INVENTION

Field of the Invention

The present invention relates to fuel injector valves for engines, such as two-stroke marine engines. In particular, the present invention relates to fuel injector valves for injecting non-Newtonian fuel, such as a slurry fuel or emulsion fuel.

Description of the Related Technology

Current injection technology within diesel engines employs oil-based Newtonian fuels derived from liquid hydrocarbons. This may include, but is not limited to, conventional diesel, marine diesel oil, marine gas oil and heavy fuel oil. Conventional diesel engines employ pressure atomization of relatively low viscosity fuel with Newtonian properties.

In order for the fuel to burn, the fuel needs to be pumped at high pressure into a chamber within the fuel injector valve. Conventional fuel systems use a high-pressure pump and common rail technology to deliver high pressure fuel, typically at up to 1000 bar, to the fuel injector valve. In other engines, such as marine common rail four-stroke engines, the pressure can be as high as 1500 bar. A volume of fuel, therefore, is maintained at high pressure in conventional fuel systems.

It is known to replace the heavy fuel oil with a slurry fuel or an emulsion fuel, which have significantly different properties compared to heavy fuel oils. The slurry fuel can be a carbonaceous aqueous slurry fuel. That is a suspension of carbon particles, such as coal or solidified bitumen, in water. An emulsion fuel can be an emulsion of liquid particles of hydrocarbon, such as bitumen, and water. As compared to heavy fuel oil or diesel, carbonaceous aqueous slurry fuels can have a higher viscosity, have a non-Newtonian rheology and are more difficult to atomise. The solid carbon particles of the carbonaceous aqueous slurry fuels can tend to deposit when the slurry fuel is not flowing.

The combustion, transportation, storage and utilization of these carbonaceous aqueous slurry fuels may cause a number of technical problems. The carbonaceous solid particles in the slurry can settle in tanks and fuel lines, and may block smaller orifices of the fuel injection equipment, during engine operation and/or when stopped.

Experiments have shown that slurry fuels can change characteristics in terms of stability and rheology across pressure differentials. In some cases, slurry fuels react negatively when the slurry fuel is exposed to a high pressure for extended periods of time. For example, the slurry fuels can behave adversely to high shear or cavitation conditions, such as may be experienced through pressure relief valves and throttling valves. It has been observed that the particles may precipitate out of solution and/or particles may agglomerate at various positions in the fuel system. This means that conventional fuel injectors, such as that shown in EP 3 070 322, may not work effectively or even at all with slurry fuels.

Known fuel injection systems using slurry fuels are disclosed in U.S. Pat. Nos. 4,782,794 and 5,056,469, in which the slurry fuel is injected with a high pressure in the fuel injection system. A problem with the known fuel injection systems is that precipitation and agglomeration of the solid fuel component of the slurry fuel can occur anywhere in the fuel system. This degrades the susceptibility of atomisation of aqueous slurries, which can cause increased ignition delay and incomplete combustion and in turn can contribute to misfire of the engine, ring damage and reduction in engine longevity. Furthermore, such precipitation and agglomeration can hinder or prevent correct operation of fuel injector systems, and can in some cases cause blockages in fuel injector systems.

SUMMARY

According to the present invention, there is provided a slurry fuel injector valve, comprising: a fuel outlet valve through which slurry fuel is able to exit the slurry fuel injector valve towards a combustion chamber of an engine; a pump cavity; a pump element that divides the pump cavity into a pump chamber and an actuation chamber; a fuel conduit through which slurry fuel is flowable from the pump chamber to the fuel outlet valve; and an actuation fluid conduit through which actuation fluid is flowable from the actuation chamber to the fuel outlet valve.

This means that actuation fluid is usable to flush the fuel outlet valve, to help dislodge or remove carbonaceous or other hard-wearing particles that might have accumulated there. Such dislodged material can thereafter be urged out of the fuel outlet valve by the slurry fuel and/or actuation fluid.

Optionally, the fuel outlet valve comprises first and second valve elements that are co-operable with each other to control the exit of slurry fuel from the slurry fuel injector valve towards the combustion chamber of the engine. Optionally, the fuel outlet valve is configured so that actuation fluid is expellable from the actuation fluid conduit and into contact with one or both of the first and second valve elements.

Optionally, the fuel outlet valve comprises a needle valve having a bore, a needle fuel chamber, and a valve needle that is moveable in the bore to protrude from within the bore into the needle fuel chamber to a variable extent. Optionally, the actuation fluid conduit opens into the bore at an actuation fluid conduit outlet, whereby actuation fluid is expellable from the actuation fluid conduit outlet and into contact with one or both of the valve needle and the bore.

Optionally, the valve needle is rotatable relative to the bore.

Optionally, the actuation fluid conduit outlet is arranged relative to the valve needle so that actuation fluid is expellable from the actuation fluid conduit outlet and against a portion of the valve needle to encourage rotation of the valve needle in the bore.

Optionally, a surface of the portion of the valve needle comprises at least one groove.

Optionally, at least part of the or each groove extends in a direction that is non-perpendicular to an axial direction of the valve needle.

Optionally, the direction is oblique to the axial direction of the valve needle.

Optionally, the part of the or each groove is helical.

Optionally, the or each groove is helical.

Optionally, the valve needle and the bore are relatively dimensioned so that actuation fluid is flowable from the bore into the needle fuel chamber.

Optionally, the fuel conduit opens into the needle fuel chamber.

Optionally, the slurry fuel injector valve comprises an actuation fluid inlet through which actuation fluid is flowable into the actuation chamber and the actuation fluid conduit from an actuation fluid source.

Optionally, the slurry fuel injector valve comprises an actuation control valve for controlling flow of actuation fluid through the actuation fluid inlet.

Optionally, the slurry fuel injector valve comprises an actuation fluid outlet arranged fluidly in parallel to the actuation fluid inlet and through which actuation fluid is expellable from the actuation chamber.

Optionally, the pump element comprises a shuttle piston.

BRIEF DESCRIPTION OF THE DRAWINGS

Embodiments of the invention will now be described, by way of example only, with reference to the accompanying drawings, in which.

DETAILED DESCRIPTION OF CERTAIN INVENTIVE EMBODIMENTS

Figure 1:
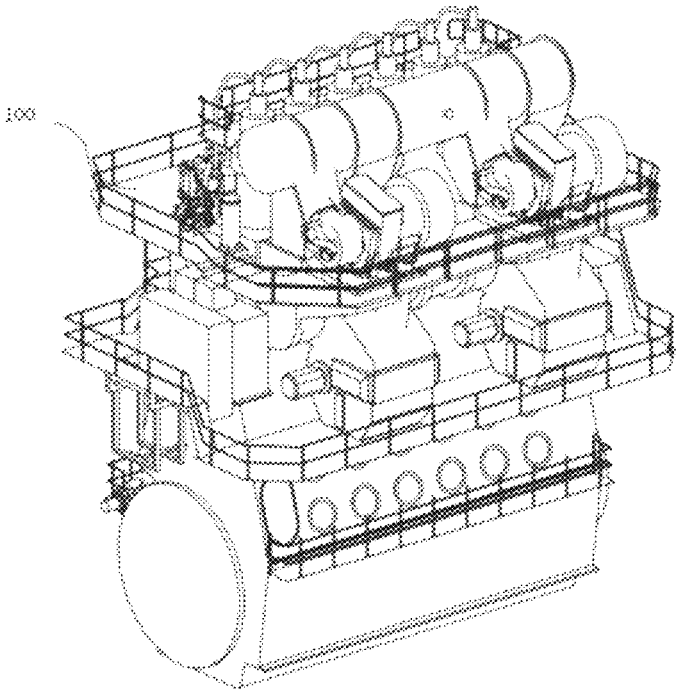
FIG. 1 shows a perspective view of an engine.

FIG. 1 shows a perspective view of an engine 100 with which the fuel injector valve 200 shown in FIG. 2 and discussed hereinafter is useable.

In this embodiment, the engine 100 is a large low-speed turbocharged two-stroke engine. In the embodiment of FIG. 1, the engine 100 has six cylinders in line. Large low-speed turbocharged two-stroke engines have typically between four and fourteen cylinders in line, carried by an engine frame. The engine 100 in some embodiments is used in conjunction with another similar or identical engine. In this embodiment, the engine is a marine engine. The engine 100 may be used as the main engine, or one of the main engines, in an ocean-going vessel. The engine 100 may be coupled to the propeller shaft of the vessel. However, in other embodiments the engine 100 can be another type and/or size of engine. For example, the engine may be a stationary engine for operating a generator in a power station. The total output of the engine may, for example, range from 1,000 to 110,000 kW.

The engine 100 of FIG. 1 has six fuel injector valves: one per cylinder. Of course, the number of fuel injector valves present in an engine can vary depending on the number of cylinders that are present in the engine 100. Moreover, in some embodiments, there may be plural fuel injector valves 200 per cylinder.

In embodiments of the present invention, the fuel to be injected, such as heavy fuel oil or diesel, is replaced with a slurry fuel. In some embodiments, the slurry fuel is a carbonaceous aqueous slurry fuel. In some embodiments, the slurry fuel is a micronized refined carbon (MRC) fuel. Alternatively, the slurry fuel may be referred to as a coal and water mixture (CWM). That is a suspension of carbon particles, such as coal or solidified bitumen, in water. In other embodiments, the fuel is an emulsion of liquid particles of hydrocarbon, such as bitumen, and water. In yet further embodiments, the slurry fuel comprises a solid fuel particulate component in a liquid solution, or a liquid fuel droplet component in a different liquid component.

The slurry fuel has different properties compared to heavy fuel oils or other oil-based hydrocarbon fuels. As noted above, as compared to heavy fuel oil or diesel, carbonaceous aqueous slurry fuels can have a higher viscosity, have a non-Newtonian rheology and are more difficult to atomise. The solid carbon particles of the carbonaceous aqueous slurry fuels can have a tendency to deposit, when the slurry fuel is not flowing.

Herein, for the purposes of brevity, the term "slurry fuel" will cover carbonaceous aqueous slurry fuels, emulsion fuels and other slurry fuels.

The fuel injector valve 200 will now be described in more detail with reference to FIG. 2.

Figure 2:
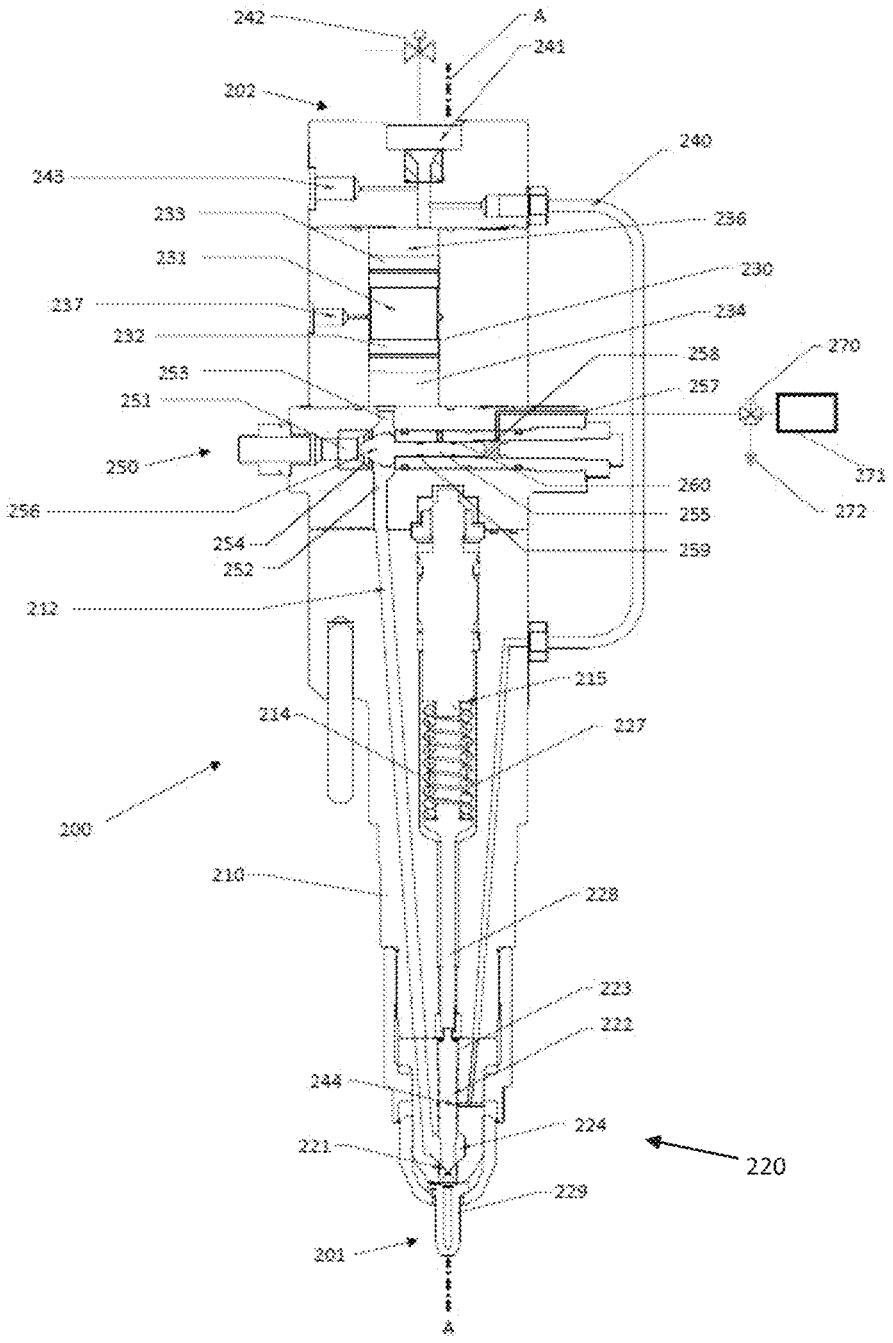
FIG. 2 shows a schematic cross-sectional side view of a fuel injector valve according to an embodiment of the present invention.

FIG. 2 shows a schematic cross-sectional side view of the fuel injector valve 200. As the fuel injector valve 200 is for injecting slurry fuel, it is also referred to herein as a slurry fuel injector valve. The fuel injector valve 200 is elongate and extends along a longitudinal axis A-A. The fuel injector valve 200 has a first end 201 and a second end 202. The fuel injector valve 200 is generally tapered in cross section from the second end 202 to the first end 201, and is generally cylindrical or conical in shape. In other embodiments, the fuel injector valve 200 may by non-tapered and/or may be other than generally cylindrical or conical in shape.

The fuel injector valve 200 comprises a housing 210 for mounting the fuel injector valve 200 to the engine or other suitable structure proximate the engine 100. The housing 210 surrounds and protects the internal parts of the fuel injector valve 200. It is to be understood that in some embodiments the housing 210 is a single component, and in other embodiments the housing 210 comprises an assembly of plural components.

Broadly speaking, the fuel injector valve 200 has a fuel outlet valve 220 through which slurry fuel is able to exit the fuel injector valve 200 towards a combustion chamber of an engine, such as the engine 100 of FIG. 1; a pump cavity 230, a pump element 231 that divides the pump cavity 230 into a pump chamber 234 and an actuation chamber 236; a fuel conduit 212 through which slurry fuel is flowable from the pump chamber 234 to the fuel outlet valve 220; and an actuation fluid conduit 240 through which actuation fluid is flowable from the actuation chamber 236 to the fuel outlet valve 220. These and other parts of the fuel injector valve 200 will be described in turn below.

Figure 3:
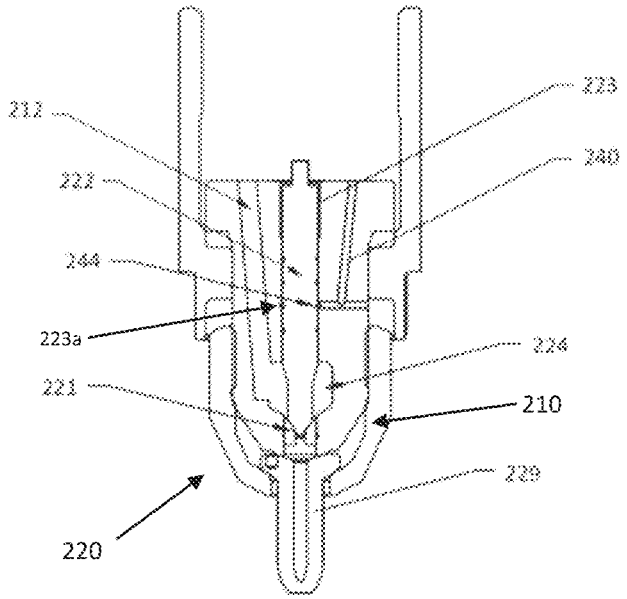
FIG. 3 shows a partial schematic cross-sectional side view of a fuel outlet valve of the fuel injector valve of FIG. 2.

FIG. 3 shows a partial schematic cross-sectional side view of the fuel outlet valve 220. In this embodiment, the fuel outlet valve 220 comprises a nozzle 229 through which the slurry fuel exits the fuel outlet valve 220 towards a combustion chamber of an engine. In this embodiment, the nozzle 229 is a separate element at the first end 201 of the fuel injector valve 200 that is mounted to the housing 210 of the fuel injector valve 200. The nozzle 229 may be removable and replaceable. In other embodiments, the nozzle 229 may be integral with the housing 210.

In this embodiment, the fuel outlet valve 220 comprises a needle valve 220, but in other embodiments other forms of valve could instead be used. The needle valve 220 comprises first and second valve elements that are co-operable with each other to control the exit of slurry fuel through the nozzle 229 from the slurry fuel injector valve 200 towards the combustion chamber of the engine. In this embodiment, the first and second valve elements are a needle valve seat 221 and a valve needle 222. However, in embodiments in which a valve other than a needle valve is used, other co-operable valve elements may instead be present.

The needle valve 220 also comprises a bore 223 and a needle fuel chamber 224. The bore 223 and the needle fuel chamber 224 are defined by the housing 210 of the fuel injector valve 200. The valve needle 222 is located in the bore 223 and is moveable in the bore 223 to protrude from within the bore 223 into the needle fuel chamber 224 to a variable extent. More specifically, the valve needle 222 is mounted for movement between an open position and a closed position. At the open position, the valve needle 222 is spaced from the needle valve seat 221 to permit slurry fuel to flow from the needle fuel chamber 224 out from the slurry fuel injector valve 200 towards the combustion chamber of the engine via the nozzle 229. At the closed position, the valve needle 222 abuts against the needle valve seat 221 to hinder or prevent slurry fuel flowing from the needle fuel chamber 224 out from the slurry fuel injector valve 200 towards the combustion chamber of the engine.

The valve needle 222 is biased towards the closed position. More specifically, and with reference again to FIG. 2, in this embodiment the valve needle 222 is coupled to a needle piston 228. A spring 227 is mounted in a spring chamber 214 between the needle piston 228 and a spring shoulder 215 that is fixed relative to the housing 210. In this embodiment, the spring 227 is a coil spring and urges the needle piston 228 and the valve needle 222 towards the first end 201 of the fuel injector valve 200 and the closed position. In other embodiments, the valve needle 222 may be biased towards the closed position by a different type of spring or any other suitable biasing device.

In this embodiment, the valve needle 222 is rotatable relative to the bore 223 about an axis B-B that extends in an axial direction of the valve needle 222, as will be described in more detail below. In this embodiment, the valve needle 222 is elongate and so the axial direction is a longitudinal direction of the valve needle 222. However, in other embodiments, the valve needle 222 may be non-rotatable relative to the bore 223. The valve needle 222 itself will be described in more detail with reference to FIG. 4.

Figure 4:
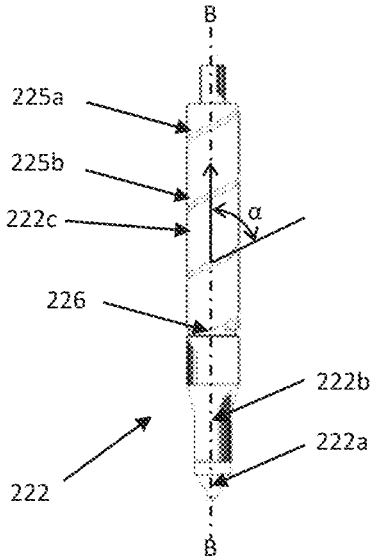
FIG. 4 shows a schematic side view of a valve needle of the fuel outlet valve of FIG. 3.

FIG. 4 shows a schematic side view of the valve needle 222 of the fuel outlet valve 220 of FIG. 3. The valve needle 222 comprises a tip 222*a*, a fuel chamber portion 222*b*, and a sealing portion 222*c*. The needle tip 222*a* is for abutting the needle valve seat 221 of the needle valve 220. The sealing portion 222*c* is for location in the bore 223 and outside of the needle fuel chamber 224 of the needle valve 220. The fuel chamber portion 222*b* is between the tip 222*a* and the sealing portion 222*c*, and is for location in the needle fuel chamber 224 of the needle valve 220.

In this embodiment, the fuel chamber portion 222*b* has a smaller width perpendicular to an axial direction of the valve needle 222 than the sealing portion 222*c*. This enables the fuel chamber portion 222*b* to occupy less space in the needle fuel chamber 224 than it would if the fuel chamber portion 222*b* had the same width as the sealing portion 222*c*. This in turn can aid circulation and flow of slurry fuel in the needle fuel chamber 224. In this embodiment, each of the sealing portion 222*c* and the fuel chamber portion 222*b* has a circular cross section, so the width is a diameter. However, in other embodiments, one or each of the cross sections may be other than circular. In some embodiments, the fuel chamber portion 222*b* and the sealing portion 222*c* have substantially equal respective widths perpendicular to the axial direction of the valve needle 222.

A surface of the sealing portion 222*c* of the valve needle 222 comprises plural grooves 225*a*, 225*b*. In this embodiment, there are two grooves 225*a*, 225*b*. In some other embodiments, there may be only one such groove in the surface of the sealing portion 222*c*. In some still further embodiments, the surface of the sealing portion 222*c* may be free from grooves. For example, the surface of the sealing portion 222*c* may be entirely smooth or flat.

In this embodiment, each of the grooves 225*a*, 225*b* is a helical groove. As a result, each of the grooves 225*a*, 225*b* extends in a direction that is non-perpendicular to the axial direction of the valve needle 222. That is, an angle $\alpha$ between the axial direction, which is indicated by the arrow in FIG. 4, and the direction of the grooves 225*a*, 225*b* is less than 90 degrees. Indeed, in this embodiment the direction is oblique to the axial direction of the valve needle 222. This means that the angle $\alpha$ also is greater than 0 degrees. Accordingly, liquid received in the grooves 225*a*, 225*b*, as will be described in more detail below, is able to travel in the grooves 225*a*, 225*b* so as to spread along the length of the sealing portion 222*c* of the valve needle 222. This helps to lubricate movement of the valve needle 222 in the bore 223. It also helps to ensure that the moveable valve needle 222 is supported relative to the bore 223 by the incompressible liquid over a longitudinally-extending portion of the valve needle 222, thereby to help maintain the valve needle 222 at a substantially central coaxial position in respect of the bore 223 and the needle valve seat 221. In some embodiments, such as that illustrated in FIG. 4, the two helical grooves 225*a*, 225*b* may be arranged as a double helix. In other embodiments, this may not be the case.

While helical grooves have been described, in other embodiments only a part of the or each groove 225*a*, 225*b* may be helical. In some embodiments, no part of the or each groove is helical. In some such embodiments, the or each groove may still be shaped so that at least part of the or each groove extends in a direction that is non-perpendicular to an axial direction of the valve needle 222, such as a direction that is oblique to the axial direction of the valve needle 222. For example, at least part of the or each groove may be curved or linear and extend in a direction that is non-perpendicular or oblique to the axial direction of the valve needle 222. In some embodiments, such as when the or each groove is on a conical or tapering section of the valve needle, at least part of the or each groove may be a spiral.

In some embodiments, the angle $\alpha$ may be between 10 and 80 degrees, such as between 30 and 60 degrees, such as approximately 45 degrees. In some embodiments, the angle $\alpha$ may be 0 degrees, so that the or each groove 225*a*, 225*b* (or at least a part of the or each groove 225*a*, 225*b*) extends in a direction parallel to the axial direction of the valve needle 222.

Although not present in every example, in this embodiment the valve needle 222 and the bore 223 are relatively dimensioned so that the liquid is able to flow from the helical grooves 225*a*, 225*b* and the bore 223 into the needle fuel chamber 224. The purpose and benefit of this will be explained below. Moreover, the surface of the sealing portion 222*c* of the valve needle 222 comprises a circumferential groove 226 that extends fully around the circumference of the valve needle 222 to define an annular closed path. The circumferential groove 226 is located between the helical grooves 225*a*, 225*b* and the fuel chamber portion 222*b* of the valve needle 222. The circumferential groove 226 helps to limit the rate at which the liquid flows or leaks from the bore 223 into the needle fuel chamber 224. Therefore, the circumferential groove 226 helps to encourage some of the liquid to remain between the bore 223 and the sealing portion 222*c* of the valve needle 222, to perform the lubrication and needle alignment functions described above.

In this embodiment, each of the helical grooves 225*a*, 225*b* terminates in the circumferential groove 226. This helps to encourage flow of the liquid from the helical grooves 225*a*, 225*b* into the circumferential groove 226. The liquid held in the circumferential groove 226 further helps to lubricate and align the needle 222 as described above. However, in some embodiments, one or each of the helical grooves 225*a*, 225*b* may not terminate in the circumferential groove 226. In other embodiments, there may be more than one circumferential groove 226 located between the helical grooves 225*a*, 225*b* and the fuel chamber portion 222*b* of the valve needle 222. In still further embodiments, there may be no circumferential groove 226 located between the groove(s) 225*a*, 225*b* and the fuel chamber portion 222*b* of the valve needle 222.

In the valve needle 222 of FIG. 4, a pitch of each of the helical grooves 225*a*, 225*b* is substantially constant along the full length of the respective helical groove 225*a*, 225*b*. However, in other embodiments, the pitch of the or each groove may be different at different portions of the groove.

Figure 5:
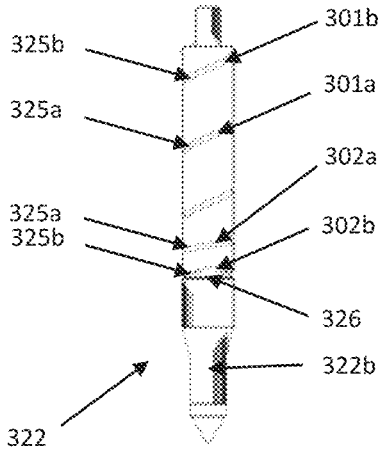
FIG. 5 shows a schematic side view of another valve needle that is usable in the fuel outlet valve of FIG. 3 according to another embodiment of the present invention.

For example, FIG. 5 shows a schematic side view of another valve needle that is usable in the fuel outlet valve of FIG. 3, according to another embodiment of the present invention. The valve needle 322 of FIG. 5 is the same as that of FIG. 4, except for the form of the helical grooves in the sealing portion of the valve needle 322. In the valve needle 322 of FIG. 5, each of the helical grooves 325*a*, 325*b* has a first groove portion 301*a*, 301*b* and a second groove portion 302*a*, 302*b*. The second groove portions 302*a*, 302*b* are located between the respective first groove portions 301*a*, 301*b* and the fuel chamber portion 322*b* of the valve needle 322.

In each of the grooves 325*a*, 325*b*, a pitch of the second groove portion 302*a*, 302*b* is less than a pitch of the first groove portion 301*a*, 301*b*. Therefore, there are relatively more turns of the grooves per unit length of the valve needle 322 in the respective second groove portions 302*a*, 302*b* than in the respective first groove portions 301*a*, 301*b*. This helps to limit the rate at which liquid is flowable or able to leak from the helical grooves 325*a*, 325*b* and the bore into the needle fuel chamber. As a result, in some embodiments, the circumferential groove 326 shown in this embodiment may be omitted.

Furthermore, there are relatively fewer turns of the grooves per unit length of the valve needle 322 in the respective first groove portions 301*a*, 301*b* than in the respective second groove portions 302*a*, 302*b*. It is towards these first groove portions 301*a*, 301*b* that the actuation fluid would be expelled. Since the grooves follow paths that are closer aligned to the axial direction of the valve needle 322 in the respective first groove portions 301*a*, 301*b*, the surface area of the grooves that would face the fluid conduit outlet 244 (described below) is increased. As such, this arrangement increases the proportion of the expelled actuation fluid that can cause rotation of the valve needle 222.

In valve needle 322 of FIG. 5, the pitch of each of the helical grooves 325*a*, 325*b* increases with distance from the fuel chamber portion 322*b* of the valve needle 322. In other embodiments, the pitch may vary stepwise between the first groove portions 301*a*, 301*b* and the respective second groove portions 302*a*, 302*b*. Moreover, in embodiments in which only a part of the or each groove is helical, similarly the pitch of the helical part of the groove may be different at different portions of the groove. Again, the variation in pitch may be with distance from the fuel chamber portion of the valve needle 322, or stepwise.

In some embodiments, a depth (from the surface of the valve needle 222, 322) and/or a width (perpendicular to the depth, and normal to the longitudinal direction of the groove) of the of each groove 225*a*, 225*b*, 325*a*, 325*b* could be different at different sections of the groove. The depth and/or width could vary with distance from the fuel chamber portion of the valve needle 222, 322, or stepwise.

Returning to FIG. 2, as noted above, the fuel injector valve 200 has a pump cavity 230, and a pump element 231 that divides the pump cavity 230 into a pump chamber 234 and an actuation chamber 236. The pump chamber 234 is for receiving slurry fuel from a fuel supply valve 250, which will be described in more detail below. The actuation chamber 236 is for receiving actuation fluid to act on the pump element 231 to pump the slurry fuel from the pump chamber 234 to the fuel outlet valve 220. These processes are also described in more detail below.

The pump element 231 in this embodiment is a shuttle piston 231, which is slidably movable in the pump cavity 230. Although not essential in every embodiment, in this embodiment shuttle seal oil is delivered to a clearance between the shuttle piston 231 and a surface of the pump cavity 230 from a shuttle seal oil inlet 237 that opens into the pump cavity 230. The shuttle seal oil lubricates the shuttle piston 231 and helps to isolate the actuation chamber 236 from the pump chamber 234.

The shuttle piston 231 comprises a pump piston 232 that is slidably mounted in the pump chamber 230 and arranged to exert a force on the slurry fuel, and an actuation piston 233 that is coupled to the pump piston 232 and arranged to transmit a force to the pump piston 232. In this embodiment, the axis along which the pump piston 232, and indeed the whole shuttle piston 231, moves is offset from the longitudinal axis A-A of the fuel injector valve 200. In other embodiments, there may be no such offset.

In some embodiments, the pump piston and the actuation piston may be embodied together in a single piston, or the pump element 231 may be other than a shuttle piston and/or may not be slidibly movable in the pump cavity 230. In some embodiments, the pump element 231 may be a fluid-actuatable pump element other than a pump piston. For example, the pump element 231 may be a diaphragm of a diaphragm pump in some embodiments.

The fuel injector valve 200 further comprises the fuel supply valve 250 for selectively placing the pump chamber 230 in fluid communication with a fuel inlet port 251 of the fuel supply valve 250. The fuel supply valve 250 will now be described in more detail with reference to FIG. 6.

Figure 6:
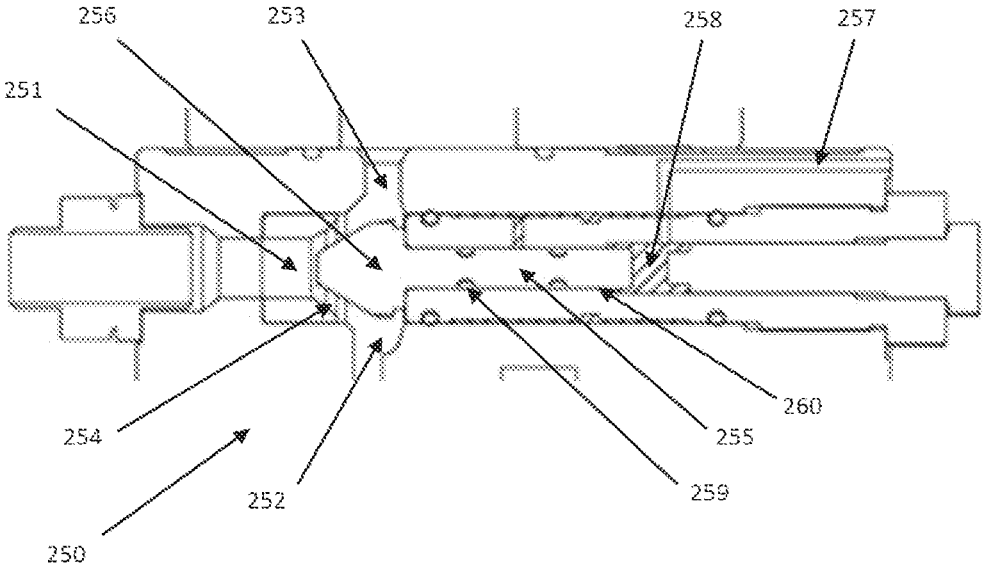
FIG. 6 shows a partial schematic cross-sectional side view of a fuel supply valve of the fuel injector valve of FIG. 2.

FIG. 6 shows a partial schematic cross-sectional side view of the fuel supply valve 250 of the fuel injector valve 200 of FIG. 2. The fuel supply valve 250 comprises the fuel inlet port 251, which is for fluid communication with one or more fuel sources. The one or more slurry fuel sources are not shown in FIG. 6, but any suitable arrangement may be used.

The fuel supply valve 250 is for controlling the flow of slurry fuel into the fuel supply valve 250 and the fuel injector valve 200 as a whole.

The fuel supply valve 250 comprises a fuel outlet port 252 for fluid communication with the fuel outlet valve 220 of the fuel injector valve 200. In this embodiment, the fuel outlet port 252 is in fluid communication with the needle fuel chamber 224 via the fuel conduit 212. The fuel conduit 212 opens into the needle fuel chamber 224. Since slurry fuel can have a relatively low calorific property, relatively more fuel may be required to generate a certain amount of power. So, in some embodiments, there may be more than one fuel conduit 212 through which slurry fuel flows from the fuel outlet port 252 to the fuel outlet valve 220. The provision of more than one fuel conduit 212 permits more slurry fuel to reach the fuel outlet valve 220 and thus increase the energy-per-injection-cycle. As mentioned previously, some engines will have plural fuel injector valves 200 for inputting fuel into the or each combustion chamber, to increase the power of the engine.

The fuel supply valve 250 also comprises a pump chamber port 253 that is in fluid communication with the pump chamber 234.

The fuel supply valve further comprises a valve seat 254, at the fuel inlet port 251, and a valve body 255 having a valve head 256. The valve head 256 acts as a valve gate and is for cooperation with the valve seat 254 to control the flow of slurry fuel through the fuel inlet port 251. The valve body 255 is mounted for linear movement in a valve bore 260 relative to the valve seat 254 between a first position, as shown in FIG. 6, and a second position. The valve bore 260 is defined by the housing 210 of the fuel injector valve 200. In some embodiments, the fuel supply valve 250 may therefore be considered a fluid-actuatable poppet valve. However, in other embodiments the fuel supply valve 250 may be other than a poppet valve, and/or the movement of the valve body 255 and head 256 could be other than linear movement, such as a rotational movement or a combination of rotational and translational movement, for example a pivoting or camming movement.

In the first position, the valve head 256 is spaced from the valve seat 254 to permit slurry fuel to flow through the fuel inlet port 251 towards the pump chamber port 253 and into the pump chamber 234. In some embodiments, there may be a spring or other biasing device to urge the valve head 256 towards the first position. In the second position, the valve head 256 abuts against the valve seat 254 to hinder or prevent slurry fuel flowing through the fuel inlet port 251 towards the pump chamber port 253 and the pump chamber 234. That is, the fuel inlet port 251 is, or is substantially, out of fluid communication with the pump chamber port 253 and the pump chamber 234, when the valve head 256 is at the second position.

In this embodiment, the pump chamber port 253 is in fluid communication with the fuel conduit 212 regardless as to whether the valve head 256 is at the first position or the second position. However, in some embodiments, the valve head 256 may put the pump chamber port 253 and the pump chamber 234 out of fluid communication with the fuel conduit 212 when the valve head is at the second position. Alternatively, the fuel injector valve 200 may comprise another mechanism for selectively placing the fuel outlet port 252 in fluid communication with the fuel conduit 212. In some embodiments, the fuel conduit 212 bypasses the fuel supply valve 250, so that fuel can flow from the pump chamber 234 to the fuel outlet valve 220 without passing through the fuel supply valve 250.

The fuel supply valve 250 of this embodiment is fluid-actuatable. More specifically, the valve head 256 may be operable with a valve actuation liquid from an engine. The engine may be that into which the fuel injector valve 200 is to be installed to inject slurry fuel into a combustion chamber thereof. In particular, the fuel supply valve 250 comprises a valve actuation chamber 258, into which valve actuation liquid is receivable to exert a force on the valve head 256 to drive the valve head 256 away from the first position and towards the second position. More specifically, the valve actuation chamber 258 is on an opposite side of the valve head 256 from the valve seat 254. Accordingly, feeding the valve actuation liquid into the valve actuation chamber 258 causes movement of the valve head 256 away from the first position and towards the second position. The valve actuation liquid may be an oil, such as servo oil.

In this embodiment, the valve actuation chamber 258 is isolated from the pump chamber port 253. More specifically, the valve head 256 itself blocks a flow path between the valve actuation chamber 258 and the pump chamber port 253. This helps avoid the slurry fuel being contaminated with the valve actuation liquid, and helps avoid the slurry fuel contaminating the valve actuation liquid and degrading the fuel supply valve 250.

In this embodiment, the valve body 255 has one or more grooves 259 therein for receiving the valve actuation liquid between the valve body 255 and the valve bore 260 to lubricate movement of the valve body 255 in the valve bore 260 and to further help seal the slurry fuel from the valve actuation liquid. The groove(s) 259 are in fluid communication with the valve actuation chamber 258, so that the valve actuation liquid is able to flow into the groove(s) 259 from the valve actuation chamber 258. Each of the one or more grooves may be a circumferential groove that extends fully around a circumference of the valve body 255, or may be a groove that follows an alternative path.

As shown in FIG. 2, in this embodiment the fuel injector valve 200 comprises a control valve 270 for controlling the input of valve actuation liquid into the valve actuation chamber 258. More specifically, the fuel supply valve 250 comprises a valve actuation liquid conduit 257 via which valve actuation liquid is flowable into and out of the valve actuation chamber 258, and the control valve 270 is for controlling flow of valve actuation liquid through the valve actuation liquid conduit 257. In other embodiments, the valve actuation liquid may be flowable out of the valve actuation chamber 258 by a route other than the valve actuation liquid conduit 257, which may be controlled by the control valve 270 or another valve.

The control valve 270 has a first port for fluid communication with the valve actuation liquid chamber 258, a second port for fluid communication with a source 271 of valve actuation liquid, and a third port for fluid communication with a drain 272, and the control valve 270 is for selecting which of the second and third ports is in fluid communication with the first port. The source 271 of valve actuation liquid may be a servo oil system of an engine, such as that into which the fuel injector valve 200 is to be installed. In other embodiments, the control valve 270 could have a different number of ports. For example, in some embodiments, there may be a combined source 271 and drain 272, so that the third port could be omitted.

In this embodiment, the control valve 270 is electronically or electrically controllable, such as by an engine control unit (ECU). However, in other embodiments, other forms of control may be employed.

It is to be noted that, in other embodiments, the fuel supply valve may take a different form from that described above. For example, in some embodiments, the fuel supply valve may be other than fluid-actuatable.

With continued reference to FIG. 2, in this embodiment, the fuel injector valve 200 has an actuation fluid inlet 241 through which actuation fluid is flowable into the actuation chamber 236 and the actuation fluid conduit 240 from an actuation fluid source. The actuation fluid source is not shown in FIG. 2, but any suitable arrangement may be used. The actuation fluid flowing into the actuation chamber 236 is at relatively high pressure, such as 200 to 1,500 bar, and acts on the pump element 231 to drive the pump element 231 towards the first end 201 of the fuel injector valve 200. This action causes the slurry fuel to be pumped from the pump chamber 234 to the fuel outlet valve 220 via the fuel conduit 212. The fuel injector valve 200 has an actuation control valve 242 for controlling the flow of actuation fluid through the actuation fluid inlet 241. More specifically, the actuation control valve 242 selectively allows the high pressure actuation fluid into the actuation chamber 236 to move the pump element 231 to pump the slurry fuel. In this embodiment, the actuation control valve 242 is electronically or electrically controllable, such as by an engine control unit (ECU).

The fuel injector valve 200 also has an actuation fluid outlet 243 arranged fluidly in parallel to the actuation fluid inlet 241. Actuation fluid is expellable from the actuation chamber 236 and out of the fuel injector valve 200 through the actuation fluid outlet 243, as the volume of the actuation chamber 236 reduces on filling the pump chamber 234 with slurry fuel and movement of the pump element 231 towards the second end 202 of the fuel injector valve 200. The actuation fluid outlet 243 may return the actuation fluid to the actuation fluid source.

The actuation fluid conduit 240 fluidly connects the actuation chamber 236 with the fuel outlet valve 220. In this embodiment, the actuation fluid conduit 240 comprises an external pipe, but in other embodiments the actuation fluid conduit 240 could be embedded or internal to the fuel injector valve 200. The actuation fluid conduit 240 opens into the bore 223 of the needle valve 220 at an actuation fluid conduit outlet 244, whereby actuation fluid is expellable from the actuation fluid conduit outlet 244 and against the valve needle 222. As the actuation fluid is at a relatively high pressure, this expulsion of liquid against the valve needle 222 acts to flush the needle valve bore 223 and/or the valve needle 222, to help dislodge or remove carbonaceous or other hard-wearing particles that might have accumulated there. Such dislodged material can pass into the needle fuel chamber 224 and thereafter be urged out of the fuel outlet valve 220 into the engine combustion chamber by the slurry fuel. In this embodiment, the bore 223*a* includes a circumferential groove 223*a* at the actuation fluid conduit outlet 244. This helps to lower or avoid point loading on the side of the valve needle 222 and aids spread of the actuation fluid. In other embodiments, this circumferential groove 223*a* may be omitted.

In some embodiments, there may be plural actuation fluid conduits 240, each of which fluidly connects the actuation chamber 236 with the fuel outlet valve 220. This can enable the volume rate at which actuation fluid is sent to the fuel outlet valve 220 to be increased. In turn, this can enable greater flushing of the fuel outlet valve 220 and/or increase the pilot ignition effect of the actuation fluid (discussed below).

As noted above, the actuation control valve 242 selectively allows high pressure actuation fluid into the actuation chamber 236 to cause pumping of the slurry fuel towards the fuel outlet valve 220. It will be understood that, in this embodiment, the actuation control valve 242 also selectively allows the high pressure actuation fluid into the actuation fluid conduit 240 to flush the fuel outlet valve 220.

Accordingly, in this embodiment, the actuation fluid is used for a dual purpose: actuating the fuel injector valve 200, and flushing the fuel outlet valve 220. Moreover, the actuation control valve 242 is operable to control these two functions. Flushing the fuel outlet valve 220 each injection cycle can help to reduce or avoid significant build-up of solids, so that the fuel outlet valve 220 can remain sufficiently clear for effective operation.

In some embodiments, the actuation fluid is an actuation liquid. In some embodiments, the actuation fluid is a combustible fluid, such as a combustible oil. This means that the flushing action can also have a pilot function, whereby the actuation fluid mixes with slurry fuel in the fuel outlet valve 220 to improve the ignition properties of the fuel. In some embodiments, the actuation fluid can perform the function of lubricating the fuel outlet valve 220, such as the valve needle 222 in the bore 223, and/or provide a seal to limit or prevent movement of the slurry fuel from the needle fuel chamber 224 towards the needle piston 228 via the bore 223. The actuation fluid can thus help to maintain the integrity of the valve needle 222.

Moreover, as noted above, in this embodiment the valve needle 222 is rotatable relative to the bore 223. In this embodiment, the actuation fluid conduit outlet 244 is arranged relative to the valve needle 222 so that actuation fluid is expellable from the actuation fluid conduit outlet 244 and against a portion of the valve needle 222 such as to encourage rotation of the valve needle 222 in the bore 223. The actuation fluid conduit outlet 244 may be arranged relative to the valve needle 222 so that at least some of the actuation fluid expelled from the actuation fluid conduit outlet 244 hits the portion of the valve needle 222 in a non-radial direction or a direction substantially tangential to the surface of the needle 222. The portion of the valve needle 222 is the sealing portion 222*c* of the valve needle 222, and so the expelled actuation fluid enters the helical grooves 225*a*, 225*b* in the surface of the sealing portion 222*c*.

Since each of the grooves 225*a*, 225*b* extends in a direction that is non-perpendicular to the axial direction of the valve needle 222, the actuation fluid entering into one or each of the grooves 225*a*, 225*b* contacts respective side surfaces of the grooves 225*a*, 225*b* that extend in a direction non-perpendicular to the axial direction of the valve needle 222. This contact applies a non-radial force to the valve needle 222, thereby encouraging rotation of the valve needle 222 in the bore 223. In this embodiment, the direction in which each of the grooves 225*a*, 225*b* extends is oblique to the axial direction of the valve needle 222. Therefore, even actuation fluid expelled from the actuation fluid conduit outlet 244 that hits the portion of the valve needle 222 in a substantially radial direction of the needle 222 is able to encourage rotation of the valve needle 222 in the bore 223, because the side surfaces of the grooves 225*a*, 225*b* are angled to convert the radial movement of the actuation fluid into circumferential movement of the valve needle 222.

Therefore, in some embodiments of the present invention, during some or every injection cycle, the valve needle 222 is caused to rotate or spin relative to the needle valve seat 221. This increases the probability that the valve needle 222 does not abut the needle valve seat 221 in the same orientation every time the valve needle 222 returns to its closed position at the end of each injection cycle. Accordingly, the needle valve seat 221 and the valve needle 222 are subject to more even wear through mutual contact than a non-rotational valve needle, in which the valve needle is forced against the same part of the valve needle seat each cycle.

Figure 7:
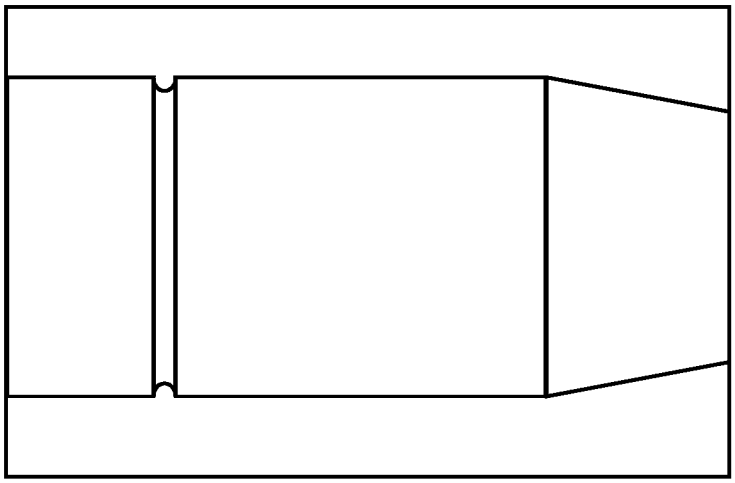
FIG. 7 shows a partial side view of a valve needle.
Figure 8:
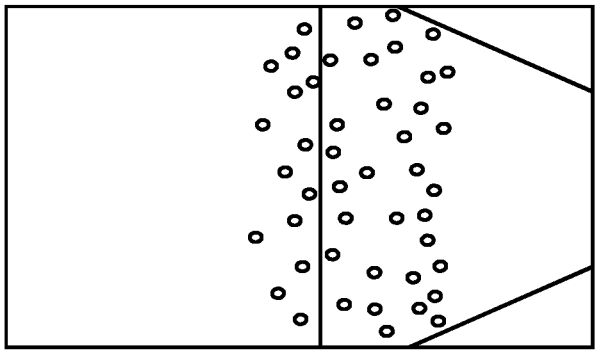
FIG. 8 shows a partial side view of a valve needle with a pitted tip.

Moreover, as noted above, carbonaceous or other hard-wearing particles can precipitate out from slurry fuels and accumulate in fuel injector valves, such as on needle valve seats or valve needle tips. Movement of the valve needle 222 to its closed position could trap such accumulated particles between the tip 222*a* of the valve needle 222 and the needle valve seat 221. This could increase wear the needle tip 222*a*, such as in the form of pitting. By way of illustration of this phenomenon, FIG. 7 shows a partial side view of a valve needle that has not undergone pitting, and FIG. 8 shows a partial side view of a valve needle that has a pitted tip. Such wear, particularly in the form of pitting, to the needle tip can reduce the effectiveness with which the valve needle and needle valve seat are able to cooperate to control the exit of slurry fuel from the slurry fuel injector valve 200.

However, as noted above, in this embodiment the valve needle 222 and the bore 223 are relatively dimensioned so that the actuation fluid is flowable from the helical grooves 225*a*, 225*b* and the bore 223 into the needle fuel chamber 224. Accordingly, in embodiments in which the actuation fluid is at a sufficiently high pressure, the actuation fluid expelled from the actuation fluid conduit outlet 244 is driven between the valve needle 222 and the bore 223 into the needle fuel chamber 224. This can help flush one or both of the co-operable valve elements of the needle valve 220, i.e. the needle valve seat 221 and/or the tip 222*a* of the valve needle 222 in this embodiment, to help dislodge or remove carbonaceous or other hard-wearing particles that might have accumulated there. Again, such dislodged material can be urged out of the fuel outlet valve 220 via the nozzle 229 and into the engine combustion chamber by the slurry fuel, thereby helping to reduce instances of needle valve tip 222*a* pitting.

Optionally, at least the tip 222*a* of the valve needle 222, 322 can be coated with or made from a relatively hard-wearing material. Example materials are tungsten carbide, silicon carbide, boron nitride, and diamond, but other materials may be used. In one embodiment, the relatively hard-wearing material, such as tungsten carbide, silicon carbide, diamond, aluminium oxide or other suitable wear resistant material, is deposited on the needle tip 222*a* using laser deposition welding whilst rotating and axially moving the valve needle 222, 322, and the valve needle 222, 322 is then ground to a suitable profile to cooperate with the valve needle seat 221. Alternatively, the entire valve needle 222, 322 may be made of the hard-wearing material, such as tungsten carbide, silicon carbide, diamond, aluminium oxide or other suitable wear resistant material. In other embodiments, the valve needle 222, 322 may be made in other ways. Similarly, one or more other parts of the fuel injector valve 200 may be coating with or made from a relatively hard-wearing material, such as any of those materials discussed above. Example parts are the valve head 255 and/or the valve seat 254 of the fuel supply valve 250, the needle valve seat 221, and the nozzle 229.

Operation of the fuel injector valve 200 of FIG. 2 will now be described.

With the valve head 255 of the fuel supply valve 250 in the first position as illustrated in FIGS. 2 and 6, slurry fuel flows from the fuel inlet port 251 through the fuel supply valve 250 and the pump chamber port 253 and into the pump chamber 234. The pressure of the slurry fuel, albeit relatively low, is sufficient to push the pump element 231 towards the second end 202 of the fuel injector valve 200 to expand the pump chamber 234. The pressure of the slurry fuel may, for example, be less than 30 bar or optionally between 20 and 30 bar. As the pump piston 232 and the actuation piston 233 are so pushed, a portion of any residual actuation fluid in the actuation chamber 236 flows out of the fuel injector valve 200 through the actuation fluid outlet 243.

When the pump chamber 234 has filled sufficiently with the slurry fuel, the control valve 270 is opened (such as under the control of the engine control unit) to permit valve actuation liquid to be driven into the valve actuation chamber 258 via the valve actuation liquid conduit 257, thereby to drive the valve head 256 of the fuel supply valve 250 away from the first position and towards the second position, so as to close the fuel inlet port 251. The valve actuation liquid in the valve actuation chamber 258 is preferably at higher pressure than the slurry fuel in the fuel inlet port 251. For example, the valve actuation liquid may be at a pressure of over 100 bar, such as between 180 and 200 bar.

Once the valve head 256 is at the second position, the actuation control valve 242 is opened (such as under the control of the engine control unit) to cause high pressure actuation fluid to rapidly flow into the actuation chamber 236 via the actuation fluid inlet 241. Since the actuation fluid is at a much greater pressure than the slurry fuel in the pump chamber 234, the actuation fluid exerts a force on the pump element 231 to cause the slurry fuel in the pump chamber 234 to be pressurised and forced into the needle fuel chamber 224 via the fuel conduit 212. This causes the valve needle 222 to move to the open position against the bias of the spring 227, to permit the slurry fuel to be pushed out of the fuel injector valve 200 and towards the engine combustion chamber via the nozzle 229. Since the valve head 256 of the fuel supply valve 250 is at the second position during this actuation of the fuel injector valve 200, slurry fuel is unable to be forced also into the fuel inlet port 251 from the pump chamber 234.

At the same time, a portion of the actuation fluid is driven from the actuation chamber 236, along the actuation fluid conduit 240 to the actuation fluid conduit outlet 244, and expelled as described above to contact and flush the bore 223 and/or the valve needle 222 located therein. As the actuation fluid is at a relatively high pressure, the actuation fluid emerges from the actuation fluid conduit outlet 244 as a burst. This helps to dislodge or flush carbonaceous or other hard-wearing particles that might have accumulated on the valve needle 222 or in the bore 223. The actuation fluid also is driven between the valve needle 222 and the bore 223 into the needle fuel chamber 224, so as to contact and flush the co-operable valve elements of the needle valve 220, i.e. the needle valve seat 221 and/or the tip 222*a* of the valve needle 222 in this embodiment, to help dislodge or remove carbonaceous or other hard-wearing particles that might have accumulated there.

Thereafter, the actuation control valve 242 is closed (such as under the control of the engine control unit) to cause the flow of high pressure actuation fluid into the actuation chamber 236 to cease. As a result, pumping of the slurry fuel from the pump chamber 234 to the fuel outlet valve 220 ceases, as does the flow of actuation fluid to the fuel outlet valve 220 via the actuation fluid conduit 240. Moreover, since the flow of slurry fuel to the fuel outlet valve 220 ceases, the needle valve 222 moves to its closed position under the biasing force of the spring 227, to prevent or hinder the flow of slurry fuel from the needle fuel chamber 224 out of the fuel injector valve 200.

Thereafter, the flow of valve actuation liquid into the valve actuation chamber 258 is caused to cease through closure of the control valve 270 (such as under the control of the engine control unit). The relatively low pressure of the slurry fuel in the fuel inlet port 251 is then sufficient to drive the valve head 256 away from the second position and towards the first position, to open the fuel inlet port 251 and begin the cycle again. During this movement of the valve head 256, at least a portion of the valve actuation liquid is expelled from the valve actuation chamber 258 to the drain 272 via the valve actuation liquid conduit 257 and the control valve 270. As such, the slurry fuel does not experience significant resistance to the valve head 256 moving to the first portion. The drain 272 may return the valve actuation liquid back to the source 271 of valve actuation liquid.

It will be appreciated that it is not the slurry fuel that is used to drive the valve head 256 away from the first position and towards the second position but another fluid. By avoiding the slurry fuel having to work against the valve head 256 to move the valve head 256 away from the first position and towards the second position, the pressure of the slurry fuel can be relatively low. This in turn helps to avoid agglomeration of solid particles from the slurry fuel in and near the fuel supply valve 250.

Moreover, in some embodiments, during movement of the valve head 256 away from the first position and towards the second position, the valve head 256 does not substantially exert a force opposing the flow of the slurry fuel from the fuel inlet port 251. This means that the slurry fuel can be maintained at a relative low pressure, and so the chances of the non-Newtonian slurry fuel precipitating out or the solid fuel particles agglomerating are lessened. However, in other embodiments, during movement of the valve head 256 away from the first position and towards the second position, the valve head 256 does exert a force opposing the flow of the slurry fuel from the fuel inlet port 251.

Optionally, such as during a maintenance cycle, the actuation control valve 242 can be activated one or more times to cause flushing of the fuel outlet valve 220. During such a maintenance cycle, a fluid other than slurry fuel, such as water, may be pumped into the pump chamber via the fuel inlet port 251. In some embodiments, during such a maintenance cycle, no fluid is pumped into the pump chamber or subsequently pumped from the pump chamber to the fuel outlet valve 220.

In other embodiments, two or more of the above described embodiments may be combined. In other embodiments, features of one embodiment may be combined with features of one or more other embodiments.

Embodiments of the present invention have been discussed with particular reference to the examples illustrated. However, it will be appreciated that variations and modifications may be made to the examples described within the scope of the invention.

What is claimed is:

1. A slurry fuel injector valve, comprising:

a fuel outlet valve through which slurry fuel is able to exit the slurry fuel injector valve towards a combustion chamber of an engine, the fuel outlet valve comprising a needle valve having a bore, a needle fuel chamber, and a valve needle that is movable in the bore to protrude from within the bore into the needle fuel chamber to a variable extent;

a pump cavity;

a pump element that divides the pump cavity into a pump chamber and an actuation chamber;

a fuel conduit through which slurry fuel is flowable from the pump chamber to the fuel outlet valve; and an actuation fluid conduit through which actuation fluid is flowable from the actuation chamber to the fuel outlet valve;

wherein the actuation fluid conduit opens into the bore at an actuation fluid conduit outlet, whereby actuation fluid is expellable from the actuation fluid conduit and into contact with one or both of the valve needle and the bore so that the actuation fluid is driven between the valve needle and the bore into the needle fuel chamber.

2. The slurry fuel injector valve according to claim 1, wherein the valve needle is rotatable relative to the bore.

3. The slurry fuel injector valve according to claim 2, wherein the actuation fluid conduit outlet is arranged relative to the valve needle so that actuation fluid is expellable from the actuation fluid conduit outlet and against a portion of the valve needle to encourage rotation of the valve needle in the bore.

4. The slurry fuel injector valve according to claim 1, wherein a surface of the portion of the valve needle comprises at least one groove.

5. The slurry fuel injector valve according to claim 4, wherein at least part of the or each groove extends in a direction that is non-perpendicular to an axial direction of the valve needle.

6. The slurry fuel injector valve according to claim 5, wherein the direction is oblique to the axial direction of the valve needle.

7. The slurry fuel injector valve according to claim 5, wherein the part of the or each groove is helical.

8. The slurry fuel injector valve according to claim 4, wherein the or each groove is helical.

9. The slurry fuel injector valve according to claim 1, wherein the fuel conduit opens into the needle fuel chamber.

10. The slurry fuel injector valve according to claim 1 comprising an actuation fluid inlet through which actuation fluid is flowable into the actuation chamber and the actuation fluid conduit from an actuation fluid source.

11. The slurry fuel injector valve according to claim 10 comprising an actuation control valve for controlling flow of actuation fluid through the actuation fluid inlet.

12. The slurry fuel injector valve according to claim 10 comprising an actuation fluid outlet arranged fluidly in parallel to the actuation fluid inlet and through which actuation fluid is expellable from the actuation chamber.

13. The slurry fuel injector valve according to claim 1, wherein the pump element comprises a shuttle piston.

* * * * *